US007232636B2

(12) United States Patent
Semura et al.

(10) Patent No.: US 7,232,636 B2
(45) Date of Patent: Jun. 19, 2007

(54) TONER FOR ELECTROSTATIC IMAGE DEVELOPMENT

(75) Inventors: Tetsuhiro Semura, Wakayama (JP); Yoshihiro Ueno, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 11/092,579

(22) Filed: Mar. 29, 2005

(65) Prior Publication Data

US 2005/0170275 A1 Aug. 4, 2005

Related U.S. Application Data

(62) Division of application No. 10/105,373, filed on Mar. 26, 2002, now abandoned.

(30) Foreign Application Priority Data

Mar. 28, 2001 (JP) ..... 2001-093043

(51) Int. Cl.
*G03G 9/087* (2006.01)

(52) U.S. Cl. ..... 430/137.18; 430/137.2; 430/109.4

(58) Field of Classification Search ..... 430/137.1, 430/137.18, 137.2, 109.4
See application file for complete search history.

(56) References Cited

U.S. PATENT DOCUMENTS

| | | | |
|---|---|---|---|
| 4,863,824 | A | 9/1989 | Uchida et al. |
| 5,047,305 | A | 9/1991 | Uchida et al. |
| 6,025,107 | A | 2/2000 | Sekiguchi et al. |
| 6,344,302 | B1 | 2/2002 | Kurose et al. |
| 6,361,914 | B1 | 3/2002 | Semura et al. |
| 6,482,561 | B1 | 11/2002 | Arai et al. |
| 6,506,530 | B1 | 1/2003 | Kido et al. |
| 6,509,130 | B1 | 1/2003 | Semura et al. |
| 6,534,229 | B2 | 3/2003 | Ohba et al. |

FOREIGN PATENT DOCUMENTS

| | | | |
|---|---|---|---|
| EP | 495475 | A | 7/1992 |
| EP | 495476 | A | 7/1992 |
| EP | 716351 | A2 | 6/1996 |
| EP | 974871 | A | 1/2000 |
| JP | 1-204065 | A | 8/1989 |
| JP | 4-313760 | A | 11/1992 |
| JP | 4-362956 | A | 12/1992 |
| JP | 8-320593 | A | 12/1996 |
| JP | 10-268558 | A | 10/1998 |
| JP | 11-305486 | A | 11/1999 |
| JP | 12-39738 | A | 2/2000 |
| JP | 2-161467 | A | 6/2002 |

OTHER PUBLICATIONS

Alger, Mark S.M. Polymer Science Dictionary. London: Elsevier Applied Science. (1989) p. 243.*

* cited by examiner

*Primary Examiner*—Christopher Rodee
(74) *Attorney, Agent, or Firm*—Birch, Stewart, Kolasch & Birch, LLP

(57) ABSTRACT

A toner for electrostatic image development comprising a resin binder comprising (a) a high-softening point polyester having a softening point of greater than 120° C. and 160° C. or less; and (b) a low-softening point polyester having a softening point of 75° C. or more and 120° C. or less, each of the high-softening point polyester (a) and the low-softening point polyester (b) being obtained by polycondensing an alcohol component consisting essentially of an aliphatic alcohol with a carboxylic acid component, wherein a difference in the softening points between the high-softening point polyester (a) and the low-softening point polyester (b) is 10° C. or more. This toner has excellent pulverizability and fixing ability, and hardly causes filming, so that it can be applied to a laser beam printer having a linear speed of 280 mm/sec or more.

29 Claims, No Drawings

TONER FOR ELECTROSTATIC IMAGE DEVELOPMENT

This application is a Divisional of application Ser. No. 10/105,373, filed on Mar. 26, 2002, now abandonded and for which priority is claimed under 35 U.S.C. §120; and this application claims priority of Application No. 2001-093043 filed in Japan on Mar. 28, 2001 under 35 U.S.C. §119; the entire contents of all are hereby incorporated by reference.

BACKGROUND OF THE INVENTION

1. Field of the Invention

The present invention relates to a toner for electrostatic image development used for developing electrostatic latent images formed in electrophotography, electrostatic recording method, electrostatic printing, and the like.

2. Discussion of the Related Art

A polyester is inherently excellent in the fixing ability. For the purpose of further improving the fixing ability, there have been made various studies on resin binders for toners comprising a polyester obtainable from an alcohol component consisting essentially of an aliphatic alcohol.

For instance, Japanese Patent Laid-Open Nos. Hei 1-204065, Hei 2-161467, and Hei 10-268558 each discloses a toner comprising as a resin binder a polyester obtained by polycondensing a monomer mixture comprising an aromatic dicarboxylic acid, an aliphatic diol, and a trivalent or higher polyvalent monomer. However, these toners are liable to cause filming even though their fixing ability is excellent.

Various reports have been made on toners with improvement of the defects of each resin by using a mixture of resins having different softening points as a resin binder, among which a combination of polyesters each made from an aromatic alcohol has been most numerously studied (Japanese Patent Laid-Open Nos. Hei 4-362956, Hei 4-313760, Hei 8-320593 and the like). In addition, Japanese Patent Laid-Open Nos. Hei 11-305486 and Hei 12-39738 each discloses a toner comprising a polyester made from an aliphatic alcohol and a polyester made from an aromatic alcohol as resin binders. However, none of these toners disclosed in the publications have sufficient improvements in pulverizability, fixing ability and filming resistance. Therefore, further improvements in these properties have been desired in a toner for high-speed devices.

An object of the present invention is to provide a toner for electrostatic image development which has excellent pulverizability and fixing ability, and hardly causes filming.

These and other objects of the present invention will be apparent from the following description.

SUMMARY OF THE INVENTION

According to the present invention, there is provided a toner for electrostatic image development comprising a resin binder comprising:

(a) a high-softening point polyester having a softening point of greater than 120° C. and 160° C. or less; and (b) a low-softening point linear polyester having a softening point of 75° C. or more and 120° C. or less, each of the high-softening point polyester (a) and the low-softening point polyester (b) being obtained by polycondensing an alcohol component consisting essentially of an aliphatic alcohol, with a carboxylic acid component, wherein the difference in the softening points between the high-softening point polyester (a) and the low softening-point polyester (b) is 10° C. or more.

DETAILED DESCRIPTION OF THE INVENTION

The resin binder of the toner of the present invention comprises a high-softening point polyester (a) and a low-softening point linear polyester (b), each of the high-softening point polyester (a) and the low-softening point polyester (b) being obtained by polycondensing an alcohol component consisting essentially of an aliphatic alcohol, with a carboxylic acid component. A polyester made from the alcohol component consisting essentially of an aliphatic alcohol has an even more excellent fixing ability as compared to a polyester made from an aromatic alcohol. Further, the polyester made from the alcohol component consisting essentially of an aliphatic alcohol has excellent compatibility with a wax. Therefore, when the toner comprises a wax as a releasing agent, the properties inherently owned by the wax can be sufficiently exhibited without causing filming. In the present specification, the phrase "alcohol component consisting essentially of an aliphatic alcohol" refers to those alcohol components in which the aliphatic alcohol is contained in the alcohol component in an amount of 98% by mol or more, preferably 99% by mol or more, more preferably 100% by mol.

The aliphatic alcohol includes, for instance, dihydric alcohols such as ethylene glycol, 1,2-propylene glycol, 1,3-propylene glycol, 1,4-butanediol, 1,5-pentanediol, 1,6-hexanediol, diethylene glycol, triethylene glycol, neopentyl glycol, dipropylene glycol, 1,4-butenediol, and 1,4-cyclohexanedimethanol; trihydric or higher polyhydric alcohols such as sorbitol, 1,2,3,6-hexanetetrol, 1,4-sorbitan, pentaerythritol, tripentaerythritol, 1,2,4-butanetriol, 1,2,5-pentanetriol, glycerol, diglycerol, 2-methyl-1,2,4-butanetriol, trimethylolethane, and trimethylolpropane; and the like. Among these aliphatic alcohols, linear or branched, dihydric alcohols having 2 to 6 carbon atoms and dimers thereof are preferable. In addition, in order to make the resulting polyester amorphous, the alcohol component preferably comprises two to five kinds of aliphatic alcohols, more preferably three to four kinds of aliphatic alcohols. When the alcohol component comprises a plural aliphatic alcohols, the content of each alcohol is preferably from 1 to 70% by mol, more preferably 5 to 60% by mol.

In addition, the dicarboxylic acid compound includes, for instance, aromatic dicarboxylic acids such as phthalic acid, isophthalic acid, and terephthalic acid; aliphatic dicarboxylic acids such as maleic acid, fumaric acid, adipic acid, succinic acid, a succinic acid substituted by an alkyl group having 1 to 20 carbon atoms or an alkenyl group having 2 to 20 carbon atoms, such as n-dodecylsuccinic acid, n-dodecenylsuccinic acid, isododecenylsuccinic acid, isooctylsuccinic acid and isooctenylsuccinic acid; acid anhydrides of these acids; lower alkyl (1 to 3 carbon atoms) esters thereof; and the like. Among the dicarboxylic acid compounds, from the viewpoints of the fixing ability and its compatibility with wax, it is preferable that at least one of the polyesters, preferably a low-softening point polyester, is made from the aliphatic dicarboxylic acid, more preferably maleic acid, fumaric acid or succinic acid. The content of the aliphatic dicarboxylic acid in the carboxylic acid component is preferably from 0.1 to 70% by mol, more preferably from 0.1 to 50% by mol.

The tricarboxylic or higher polycarboxylic acid compound includes, for instance, 1,2,4-benzenetricarboxylic acid (trimellitic acid), 2,5,7-naphthalenetricarboxylic acid, pyromellitic acid, acid anhydrides thereof, lower alkyl (1 to 3 carbon atoms) esters thereof, and the like.

The high-softening point polyester (a) is preferably a cross-linked resin, and those resins obtained by using monomers comprising a trivalent or higher polyvalent monomer are preferable. The content of the trivalent or higher polyvalent monomer in the carboxylic acid component of the high-softening point polyester (a) is preferably from 0.1 to 40% by mol, more preferably from 5 to 30% by mol.

The polycondensation of the alcohol component with the carboxylic acid component can be carried out by, for instance, polycondensing an alcohol component with a carboxylic acid component in an inert gas atmosphere at a temperature of 180° to 250° C. optionally in the presence of an esterification catalyst.

The polyester in the present invention comprises a high-softening point polyester (a) and a low-softening point polyester (b). The high-softening point polyester (a) has a softening point of greater than 120° C. and 160° C. or less, preferably from 125° to 160° C., more preferably from 135° to 160° C., and the low-softening point polyester (b) has a softening point of 75° C. or more and 120° C. or less, preferably from 800 to 115° C. The high-softening point polyester (a) serves to improve the offset resistance and the like, and the low-softening point polyester (b) serves to improve the fixing ability, the pulverizability and the like. In the present invention, since the alcohol components of the polyesters consist essentially of an aliphatic alcohol, the high-softening point polyester (a) and the low-softening point polyester (b) are entangled with each other. Therefore, properties inherently owned by both kinds of the polyesters are more effectively exhibited especially in the pulverizability, the fixing ability and the filming resistance.

The difference in the softening points between the high-softening point polyester (a) and the low-softening point polyester (b) is 10° C. or more, preferably from 20° to 80° C., more preferably from 30° to 60° C.

In the present invention, it is preferable that any of the high-softening point polyester (a) and the low-softening point polyester (b) is an amorphous polyester, wherein the difference between the softening point and the glass transition point is preferably 20° C. or more, more preferably from 30 to 100° C.

The softening point and the glass transition point of the polyester can be adjusted by monomer composition, degree of cross-linking, molecular weight or the like.

The acid value of the polyester for both the high-softening point polyester (a) and the low-softening point polyester (b) is preferably from 3 to 60 mg KOH/g, more preferably from 5 to 50 mg KOH/g. Also, the hydroxyl value of the polyester is preferably from 5 to 60 mg KOH/g, more preferably from 10 to 50 mg KOH/g.

The weight ratio of the high-softening point polyester (a) to the low-softening point polyester (b) is preferably from 20/80 to 90/10, more preferably from 20/80 to 70/30.

The total amount of the polyesters (a) and (b) in the resin binder is preferably from 50 to 100% by weight, more preferably from 80 to 100% by weight, especially preferably 100% by weight. Incidentally, the resin binder may contain a resin such as a styrene-acrylic resin, an epoxy resin, a polycarbonate or a polyurethane in a proper amount.

It is preferable that the toner of the present invention further comprises a wax. In the present invention, a low-softening point polyester having excellent compatibility with wax is used together with a high-softening point polyester which gives excellent dispersibility of the wax. Therefore, when the toner comprises a wax as a releasing agent, the properties inherently owned by the wax can be sufficiently exhibited without causing such a problem as filming. The wax includes polyolefin waxes such as polypropylene waxes, polyethylene waxes, and polypropylene-polyethylene copolymer waxes; ester waxes such as carnauba wax, haze wax, beeswax, spermaceti wax and montan wax; synthetic waxes such as Fischer-Tropsch wax; amide waxes such as aliphatic amide waxes; and the like. Among these waxes, polyolefin waxes, carnauba wax and Fischer-Tropsch wax are preferable, and the polyolefin waxes are more preferable, from the viewpoint of filming resistance. The content of the wax is preferably from 0.5 to 10 parts by weight, based on 100 parts by weight of the resin binder.

The toner of the present invention may further comprise, in addition to the resin binder, additives such as colorants, charge control agents, releasing agents, fluidity improvers, electric conductivity modifiers, extenders, reinforcing fillers such as fibrous substances, antioxidants, anti-aging agents, and cleanability improvers in proper amounts.

As the colorants, all of the dyes and pigments which are used as conventional colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. The toner of the present invention can be used as any of black toners, color toners, full-color toners. The content of the colorant is preferably from 1 to 60 parts by weight, more preferably from 1 to 10 parts by weight, based on 100 parts by weight of the resin binder.

The toner of the present invention is preferably pulverized toners, obtained by kneading pulverization method. The toner of the present invention is prepared, for instance, by homogeneously mixing a resin binder, a colorant, and the like with a mixer such as a ball-mill, thereafter melt-kneading the mixture with a closed kneader, a single- or double-screw extruder, or the like, and subsequently cooling, pulverizing and classifying the product. It is preferable that the resulting toner has a volume-average particle size of from 3 to 15 μm. Furthermore, a fluidity improver such as a hydrophobic silica may be added as an external agent to the toner surfaces.

The toner for development of electrostatic latent images of the present invention can be used alone as a developer, in a case where the fine magnetic material powder is contained; or the toner used as a nonmagnetic one-component developer, or the toner can be mixed with a carrier as a two-component developer, in a case where the fine magnetic material powder is not contained.

From the viewpoints of excellent fixing ability and filming resistance, the toner for development of electrostatic latent images of the present invention can be applied for a method for forming fixed images, which can be suitably used for a copy machine having a linear speed of 280 mm/sec or more, preferably 370 mm/sec or more, or a laser beam printer having a linear speed of 160 mm/sec or more, preferably 280 mm/sec or more. In this specification, the liner speed means a peripheral speed of a photoconductor.

EXAMPLES

[Softening Point]

Softening point refers to a temperature corresponding to ½ of the height (h) of the S-shaped curve showing the relationship between the downward movement of a plunger (flow length) and temperature, namely, a temperature at which a half of the resin flows out, when measured by using a flow tester of the "koka" type "CFT-500D" (commercially available from Shimadzu Corporation), in which a 1 g sample is extruded through a nozzle having a dice pore size of 1 mm and a length of 1 mm, while heating the sample with a programming rate of 6° C./min and applying a load of 1.96 MPa thereto with the plunger.

[Glass Transition Point]

The glass transition point is determined using a differential scanning calorimeter "DSC Model 210" (commercially available from Seiko Instruments, Inc.) with a programming rate of 10° C./min.

[Acid Value and Hydroxyl Value]

The acid value and hydroxyl value are measured by a method according to JIS K 0070.

Resin Preparation Example

The raw material monomers as shown in Table 1 were reacted in the presence of dibutyltin oxide under nitrogen gas stream, with stirring the ingredients under reduced pressure at 230° C. The reaction was terminated when a softening point determined according to ASTM E28-67 reached the desired softening point. The softening point, the glass transition point, the acid value and the hydroxyl value of each of the resulting resins are shown in Table 1.

TABLE 1

| | Resin A | Resin B | Resin C | Resin D | Resin E | Resin F | Resin G | Resin a | Resin b | Resin c |
|---|---|---|---|---|---|---|---|---|---|---|
| Propylene Glycol | | 40 | 60 | 40 | 45 | 50 | 50 | | | |
| Ethylene Glycol | 50 | 25 | 30 | 40 | 50 | | 20 | | | 45 |
| Dipropylene Glycol | | 25 | | | 10 | | 10 | | | 5 |
| Diethylene Glycol | 20 | | | | 10 | 20 | | | | |
| Neopentyl Glycol | 45 | 25 | 20 | 30 | | 30 | 20 | | | 40 |
| BPA-PO[1)] | | | | | | | | 30 | 20 | 15 |
| BPA-EO[2)] | | | | | | | | 70 | 80 | |
| Terephthalic Acid | 50 | 20 | 40 | 50 | 20 | | | 20 | 15 | |
| Isophthalic Acid | 35 | 60 | 50 | 40 | 60 | 80 | 60 | 40 | 60 | 85 |
| Succinic Acid | | | | | | | | | | |
| Fumaric Acid | | | | | | 0.5 | 40 | 10 | 15 | |
| Trimellitic Acid Anhydride | 15 | 20 | 10 | 5 | 20 | | | 30 | 7 | 12 |
| Softening Point (° C.) | 143 | 158 | 130 | 90 | 111 | 103 | 95 | 142 | 94 | 131 |
| Glass Transition Point (° C.) | 65 | 66 | 68 | 55 | 56 | 54 | 54 | 65 | 56 | 67 |
| Acid Value (mg KOH/g) | 30 | 20 | 10 | 15 | 30 | 10 | 15 | 45 | 13 | 20 |
| Hydroxyl Value (mg KOH/g) | 40 | 30 | 30 | 48 | 45 | 40 | 20 | 55 | 25 | 30 |

Note)
The amount used is expressed in molar ratio.
[1)]Propylene oxide adduct of bisphenol A (average number of moles added: 2.2 moles).
[2)]Ethylene oxide adduct of bisphenol A (average number of moles added: 2.2 moles).

Examples 1 to 6 and Comparative Examples 1 to 10

A resin binder shown in Table 2, 6 parts by weight of a carbon black "Regal 330" (commercially available from Cabot Corporation), 1.5 parts by weight of a charge control agent "T-77" (commercially available from Hodogaya Chemical Co., Ltd.) and 2 parts by weight of a releasing agent (low molecular weight polypropylene wax; melting point: 140° C.) were mixed with a Henschel mixer, and thereafter the resulting mixture was melt-kneaded with a twin-screw extruder. The resulting molten kneaded mixture was subjected to pulverization and classification using a high-speed jet mill pulverizer-classifier Model "IDS-2" (commercially available from Nippon Pneumatic MFG. Co., Ltd.) so that the resulting powder had a volume-average particle size of 8.5 μm. During pulverization and classification, the pulverizability was evaluated by the following method.

[Pulverizability]

A resin powder which passes through a 16-mesh sieve (sieve opening: 1.0 mm) but does not pass through a 22-mesh sieve (sieve opening: 710 μm) is obtained. Thirty grams of the classified resin powder is pulverized for 10 seconds with a coffee mill (commercially available from PHILIPS, Type: HR-2170), and thereafter sieved with a 30-mesh sieve (sieve opening: 500 μm). The weight of sieve-on resin powder, (A) g, is precisely measured. A residual ratio is determined from this weight by using the following equation. The above procedures are repeated 3 times, and the average value is obtained. The results are shown in Table 2.

$$\text{Residual Ratio (\%)} = \frac{A\ [\text{g}]}{30.0\ [\text{g}]} \times 100$$

(Evaluation Criteria)

◎: The average residual ratio being less than 10.0%;

○: The average residual ratio being 10.0% or more and less than 15.0%;

Δ: The average residual ratio being 15.0% or more and less than 20.0%; and

X: The average residual ratio being 20.0% or more.

Next, 0.5 parts by weight of a hydrophobic silica "R-972" (commercially available from Nippon Aerosil) was added to 100 parts by weight of the resulting powder, and mixed with a Henschel mixer, to give a toner.

Test Example 1

A toner was loaded in a modified apparatus of a copy machine "AR-505" commercially available from Sharp Corporation (linear speed: 370 mm/sec). Printing was carried out, with sequentially raising the temperature of the fixing roller from 90° to 240° C. The fixing ability of the toner was evaluated based on the lowest fixing temperature. The results are shown in Table 2. Here, the lowest fixing temperature used herein refers to the temperature of the fixing roller at which the fixing ratio according to the following equation exceeded 70% when a sand-rubber eraser to which a load of 500 g was applied, the eraser having a bottom area of 15 mm×7.5 mm, was moved backward and forward five times over a fixed image obtained through the fixing device (100° to 240° C.), and the optical reflective density of the image before or after the eraser treatment is measured with a reflective densitometer commercially available from Macbeth Process Measurements Co.

$$\text{Fixing Ratio (\%)} = \frac{\text{Image Density After Eraser Treatment}}{\text{Image Density Before Eraser Treatment}} \times 100$$

Test Example 2

A toner was loaded in a modified apparatus of a copy machine "AR-505" commercially available from Sharp Corporation (linear speed: 370 mm/sec). A 500000-sheet continuous printing was carried out, and the generation of fusing of the toner remaining on the surface of the photoconductor drum and the effect of the toner fusing on the printout images were visually observed to evaluate the extent of generation of filming by the following evaluation criteria. The results are shown in Table 2.

[Evaluation Criteria]

⊙: No generation of toner fusing;

○: Very slight toner fusing being found on the photoconductor but no effect on the fixed images; and X: Toner fusing being found on the photoconductor at 10 points or more, thereby causing defects of the fixed images.

TABLE 2

| | Resin Binder[1)] | | | | |
|---|---|---|---|---|---|
| | High-Softening Point Resin | Low-Softening Point Resin | Pulverizability | Fixing Ability | Filming Resistance |
| Comp. Ex. 1 | A/100 | — | ○ | 164° C. | X |
| Ex. 1 | A/60 | G/40 | ⊙ | 119° C. | ⊙ |
| Ex. 2 | A/40 | G/60 | ⊙ | 116° C. | ⊙ |
| Comp. Ex. 2 | — | G/100 | ⊙ | 115° C. | X |

TABLE 2-continued

| | Resin Binder[1)] | | | | |
|---|---|---|---|---|---|
| | High-Softening Point Resin | Low-Softening Point Resin | Pulverizability | Fixing Ability | Filming Resistance |
| Comp. Ex. 3 | B/100 | — | Δ | 170° C. | X |
| Ex. 3 | B/90 | D/10 | ○ | 125° C. | ○ |
| Ex. 4 | B/20 | D/80 | ⊙ | 122° C. | ⊙ |
| Comp. Ex. 4 | — | D/100 | ○ | 127° C. | X |
| Ex. 5 | C/70 | E/30 | ○ | 126° C. | ○ |
| Ex. 6 | C/70 | F/30 | ○ | 129° C. | ⊙ |
| Comp. Ex. 5 | a/100 | — | X | 175° C. | X |
| Comp. Ex. 6 | a/60 | b/40 | X | 139° C. | X |
| Comp. Ex. 7 | a/40 | b/60 | Δ | 136° C. | X |
| Comp. Ex. 8 | — | b/100 | ○ | 125° C. | X |
| Comp. Ex. 9 | C/40 | b/60 | Δ | 133° C. | X |
| Comp. Ex. 10 | c/50 | E/50 | Δ | 135° C. | X |

[1)]The amount of resin used is expressed in parts by weight.

It is clear from the above results that the toners of Examples 1 to 6 exhibit excellent property in any of the above evaluation, as compared to the toners of Comparative Examples 1 to 10. In particular, it is clear that the resin which is obtained by polycondensing an alcohol component consisting only of an aliphatic alcohol and a carboxylic acid component is significantly improved in the pulverizability, the fixing ability and the filming resistance by together using resins having different softening points, as compared to the resins obtained from an alcohol component comprising an aromatic alcohol. It is also clear that those comprising an aliphatic carboxylic acid are preferred for the carboxylic acid component of the resin.

According to the present invention, there can be provided a toner for development of electrostatic latent images which has excellent pulverizability and fixing ability, and hardly causes filming.

What is claimed is:

1. A method for the formation of a pulverized toner composition for use in electrostatic image development, comprising the steps of:

providing a homogeneous mixture comprised of a resin binder and a colorant, said resin binder comprising:

(a) a high-softening point polyester having a softening point of greater than 120° C. and 160° C. or less; and (b) a low-softening point linear polyester having a softening point of 75° C. or more and 120° C. or less, each of the high-softening point polyester (a) and the low-softening point polyester (b) being obtained by polycondensing an alcohol component consisting essentially of at least one aliphatic diol with a carboxylic acid component, wherein a difference in the softening points between the high-softening point polyester (a) and the low softening-point polyester (b) is 10° C. or more, and melt-kneading, cooling, pulverizing said mixture and classifying said pulverized mixture.

2. The method according to claim 1, wherein a weight ratio of the high-softening point polyester (a) to the low-softening point polyester (b) is from 20/80 to 90/10.

3. The method according to claim 1, wherein the high-softening point polyester is a resin obtained by using monomers comprising a trivalent or higher polyvalent monomer.

4. The method according to claim 1, further comprising a wax.

5. The method according to claim 4, wherein the wax is a polyolefin wax.

6. The method according to claim 1, wherein the carboxylic acid component in at least one of the high-softening point polyester (a) and the low-softening point polyester (b) comprises an aliphatic dicarboxylic acid.

7. The method according to claim 1, wherein a total amount of the polyesters (a) and (b) is from 50 to 100% by weight of the resin binder.

8. The method according to claim 1, wherein said high-softening point polyester (a) is obtained by use of at least one trivalent or higher polyvalent monomer and is cross-linked.

9. The method according to claim 1, wherein the carboxylic acid component in the low-softening point polyester (b) comprises fumaric acid.

10. The method according to claim 1, wherein said aliphatic alcohol is selected from the group consisting of ethylene glycol, 1,2-propylene glycol, 1,3-propylene glycol, 1,4-butanediol, 1,5-pentanediol, 1,6-hexanediol, diethylene glycol, triethylene glycol, neopentyl glycol, dipropylene glycol, 1,4-butenediol, and 1,4-cyclohexanedimethanol.

11. The method according to claim 1, wherein said carboxylic acid component is selected from the group consisting of aromatic dicarboxylic acids and aliphatic dicarboxylic acids.

12. The method according to claim 11, wherein said aromatic dicarboxylic acid is selected from the group consisting of phthalic acid, isophthalic acid, and terephthalic acid.

13. The method according to claim 1, wherein said carboxylic acid component is selected from the group consisting of maleic acid, fumaric acid, adipic acid, succinic acid, succinic acid substituted with an alkyl group having 1 to 20 carbon atoms, succinic acid substituted with an alkenyl group having from 2 to 20 carbon atoms, acid anhydrides thereof, and $C_{1-3}$ alkyl esters thereof.

14. The method according to claim 1, wherein the carboxylic acid component in the low-softening point polyester (b) is selected from the group consisting of maleic acid, fumaric acid, or succinic acid.

15. The method according to claim 1, wherein said low-softening point polyester (b) is obtained by polycondensing an alcohol component consisting essentially of an aliphatic diol with a carboxylic acid component consisting essentially of a dicarboxylic acid compound.

16. A method for the formation of a pulverized toner composition for use in electrostatic image development, comprising the steps of:

providing a homogeneous mixture comprised of a resin binder and a colorant, said resin binder comprising:

(c) a high-softening point polyester having a softening point of greater than 120° C. and 160° C. or less; and (d) a low-softening point linear polyester having a softening point of 75° C. or more and 120° C. or less, each of the high-softening point polyester (a) and the low-softening point polyester (b) being obtained by polycondensing an alcohol component consisting essentially of an aliphatic alcohol with a carboxylic acid component, wherein a difference in the softening points between the high-softening point polyester (a) and the low softening-point polyester (b) is 10° C. or more, and wherein said aliphatic alcohol comprises two to five kinds of aliphatic alcohols, and melt-kneading, cooling, pulverizing said mixture and classifying said pulverized mixture.

17. The method according to claim 16, wherein a weight ratio of the high-softening point polyester (a) to the low-softening point polyester (b) is from 20/80 to 90/10.

18. The method according to claim 16, wherein the high-softening point polyester is a resin obtained by using monomers comprising a trivalent or higher polyvalent monomer.

19. The method according to claim 16, further comprising a wax.

20. The method according to claim 19, wherein the wax is a polyolefin wax.

21. The method according to claim 16, wherein the carboxylic acid component in at least one of the high-softening point polyester (a) and the low-softening point polyester (b) comprises an aliphatic dicarboxylic acid.

22. The method according to claim 16, wherein a total amount of the polyesters (a) and (b) is from 50 to 100% by weight of the resin binder.

23. The method according to claim 16, wherein said high-softening point polyester (a) is obtained by use of at least one trivalent or higher polyvalent monomer and is cross-linked.

24. The method according to claim 16, wherein the carboxylic acid component in the low-softening point polyester (b) comprises fumaric acid.

25. The method according to claim 16 wherein said aliphatic alcohol is selected from the group consisting of ethylene glycol, 1,2-propylene glycol, 1,3-propylene glycol, 1,4-butanediol, 1,5-pentanediol, 1,6-hexanediol, diethylene glycol, triethylene glycol, neopentyl glycol, dipropylene glycol, 1,4-butenediol, and 1,4-cyclohexanedimethanol.

26. The method according to claim 16, wherein said carboxylic acid component is selected from the group consisting of aromatic dicarboxylic acids and aliphatic dicarboxylic acids.

27. The method according to claim 26, wherein said aromatic dicarboxylic acid is selected from the group consisting of phthalic acid, isophthalic acid, and terephthalic acid.

28. The method according to claim 16, wherein said carboxylic acid component is selected from the group consisting of maleic acid, fumaric acid, adipic acid, succinic acid, succinic acid substituted with an alkyl group having 1 to 20 carbon atoms, succinic acid substituted with an alkenyl group having from 2 to 20 carbon atoms, acid anhydrides thereof, and $C_{1-3}$ alkyl esters thereof.

29. The method according to claim 16, wherein the carboxylic acid component in the low-softening point polyester (b) is selected from the group consisting of maleic acid, fumaric acid, or succinic acid.

* * * * *